US009621975B2

(12) United States Patent
Liu et al.

(10) Patent No.: US 9,621,975 B2
(45) Date of Patent: Apr. 11, 2017

(54) SYSTEMS AND APPARATUS HAVING TOP PORT INTEGRATED BACK CAVITY MICRO ELECTRO-MECHANICAL SYSTEM MICROPHONES AND METHODS OF FABRICATION OF THE SAME

(71) Applicant: INVENSENSE, INC., San Jose, CA (US)

(72) Inventors: Fang Liu, San Jose, CA (US); Martin Lim, San Mateo, CA (US)

(73) Assignee: INVENSENSE, INC., San Jose, CA (US)

( * ) Notice: Subject to any disclaimer, the term of this patent is extended or adjusted under 35 U.S.C. 154(b) by 0 days.

(21) Appl. No.: 14/558,911

(22) Filed: Dec. 3, 2014

(65) Prior Publication Data

US 2016/0165331 A1 Jun. 9, 2016

(51) Int. Cl.

| | |
|---|---|
| ***H04R 3/00*** | (2006.01) |
| ***H04R 1/08*** | (2006.01) |
| ***H04R 19/00*** | (2006.01) |

(52) U.S. Cl.
CPC ..... *H04R 1/08* (2013.01); *H04R 19/005* (2013.01); *H04R 2201/003* (2013.01)

(58) Field of Classification Search
CPC ..... H04R 19/04; H04R 1/108; H04R 1/021
USPC ..... 381/111, 110, 174
See application file for complete search history.

(56) References Cited

U.S. PATENT DOCUMENTS

| | | | | |
|---|---|---|---|---|
| 6,382,030 | B1 * | 5/2002 | Kihara | G01L 9/0075 73/718 |
| 8,692,340 | B1 | 4/2014 | Ata et al. | |
| 2002/0033048 | A1 * | 3/2002 | McIntosh | G01D 5/2417 73/514.32 |

(Continued)

FOREIGN PATENT DOCUMENTS

| | | |
|---|---|---|
| WO | 2012012939 | 2/2012 |
| WO | 2012088688 | 7/2012 |
| WO | 2013185013 | 12/2013 |

OTHER PUBLICATIONS

International Search Report and Written Opinion for International Application Serial No. PCT/US15/63460, dated Feb. 22, 2016, 13 pages.

*Primary Examiner* — William Deane, Jr.
(74) *Attorney, Agent, or Firm* — Amin, Turocy & Watson, LLP

(57) ABSTRACT

A micro electro-mechanical system (MEMS) device is provided. The MEMS device includes: a first substrate having a first surface and a second surface, and a port disposed through the first substrate, wherein the port is configured to receive acoustic waves and wherein the first surface is exposed to an environment outside the MEMS device; and a diaphragm coupled to and facing the second surface and configured to deflect in response to pressure differential at the diaphragm in response to the received acoustic waves. The MEMS device also includes a second substrate coupled to and facing the diaphragm, and including circuitry, wherein the second substrate includes a recess region forming an integrated back cavity in the MEMS device. The MEMS device also includes an electrical connection electrically coupling the first substrate and the second substrate and configured to transmit an electrical signal indicative of the deflection of the diaphragm.

25 Claims, 7 Drawing Sheets

(56) References Cited

U.S. PATENT DOCUMENTS

| | | | | |
|---|---|---|---|---|
| 2002/0195673 | A1* | 12/2002 | Chou | B81B 7/0051 257/414 |
| 2004/0129953 | A1* | 7/2004 | Tamura | B81B 3/0051 257/202 |
| 2008/0176046 | A1* | 7/2008 | Yamaguchi et al. | 428/195.1 |
| 2009/0221107 | A1* | 9/2009 | Yamazaki et al. | 438/29 |
| 2011/0126632 | A1* | 6/2011 | McNeil | B81B 7/02 73/718 |
| 2011/0198714 | A1 | 8/2011 | Yang | |
| 2013/0221453 | A1 | 8/2013 | Dehe et al. | |
| 2014/0270260 | A1* | 9/2014 | Goertz | G10L 25/84 381/110 |
| 2014/0299949 | A1* | 10/2014 | Conti et al. | 257/416 |
| 2014/0355784 | A1* | 12/2014 | Han | H04R 1/406 381/92 |
| 2015/0061048 | A1* | 3/2015 | Escher-Poeppel et al. | 257/416 |
| 2015/0289045 | A1* | 10/2015 | Khenkin et al. | H04R 1/08 |
| 2015/0360936 | A1* | 12/2015 | Tayebi | B81C 1/0023 257/369 |
| 2016/0037265 | A1* | 2/2016 | Khenkin | H04R 19/04 |
| 2016/0142829 | A1* | 5/2016 | Berger | H04R 23/00 381/174 |

* cited by examiner

600

SYSTEMS AND APPARATUS HAVING TOP PORT INTEGRATED BACK CAVITY MICRO ELECTRO-MECHANICAL SYSTEM MICROPHONES AND METHODS OF FABRICATION OF THE SAME

TECHNICAL FIELD

Embodiments of the subject disclosure relate generally to micro electro-mechanical system (MEMS) microphones, and particularly to top port integrated back cavity (IBC) MEMS microphones.

BACKGROUND

With current microphone technology, microphones typically include individual MEMS die and complementary metal oxide semiconductor (CMOS) die packaged side-by-side, which leads to a large footprint (e.g., approximately 3 millimeters (mm)×3 mm). The excessive size of this footprint limits the applications to which the microphone can be applied. For example, wearable device applications utilize devices having small footprints and, as such, current microphone technology is not well-integrated into wearable device systems. The embodiments described herein can employ a configuration in which the MEMS die and the CMOS die are stacked in some embodiments and, as such, the footprint can be about half the footprint in the side-by-side configuration.

Further, some microphones disadvantageously include a port though the CMOS die thereby sacrificing a significant portion of the CMOS die area and increasing total cost. Additionally, many microphones are bottom port configuration, which results in the port at which acoustic waves are received being located at the chip electrical connection side of the device. As a result, when customers want to surface mount the microphone chip to a PCB, the customers need to open a port on the PCB, which increases complexity. In some cases, bottom port microphone packages laminate substrates also sacrifice port opening and seal ring area to provide area for more pin connections.

SUMMARY

In one embodiment, a MEMS device includes: a first substrate having a first surface and a second surface, and a port disposed through the first substrate, wherein the port is configured to receive acoustic waves and wherein the first surface is exposed to an environment outside the MEMS device; and a diaphragm coupled to and facing the second surface and configured to deflect in response to pressure differential at the diaphragm in response to the received acoustic waves. The MEMS device also includes a second substrate having a third surface and a fourth surface opposite the third surface, wherein third surface of the second substrate is coupled to and facing the diaphragm, and the second substrate includes circuitry, and wherein the second substrate includes a recess region forming an integrated back cavity (IBC) in the MEMS device; and an electrical connection electrically coupling the first substrate and the second substrate and configured to transmit an electrical signal indicative of the deflection of the diaphragm. The IBC represents the back volume of the microphone In another embodiment, a method includes: providing a first substrate having a first surface and a second surface, and a port disposed through the first substrate, wherein the port is configured to receive acoustic waves; and providing a diaphragm coupled to and facing the second surface and configured to deflect in response to pressure differential at the diaphragm in response to the received acoustic waves. The method also includes providing a second substrate having a third surface and a fourth surface opposite the third surface, wherein third surface of the second substrate is coupled to and facing the diaphragm, and the second substrate includes circuitry, and wherein the second substrate includes a recess region forming an IBC in the MEMS device. The method also includes providing an electrical connection electrically coupling the first substrate and the second substrate and configured to transmit an electrical signal indicative of the deflection of the diaphragm, wherein the first surface of the first substrate is exposed to an environment outside the MEMS device.

In yet another embodiment, a system is provided. The system includes a device and a MEMS device operably coupled to the device. The device includes: a memory to store computer-executable instructions; and a processor coupled to the memory, that facilitates execution of the executable instructions to perform operations comprising: receipt, from a MEMS device, of information indicative of acoustic waves representative of speech including a command; identification of the command; and performance of one or more functions based on the command. The MEMS device includes: a first substrate having a first surface and a second surface, and a port disposed through the first substrate, wherein the port is configured to receive the acoustic waves and wherein the first surface is exposed to an environment outside the MEMS device; and a diaphragm coupled to and facing the second surface and configured to deflect in response to pressure differential at the diaphragm in response to the received acoustic waves. The MEMS device also includes a second substrate having a third surface and a fourth surface opposite the third surface, wherein third surface of the second substrate is coupled to and facing the diaphragm and the second substrate includes circuitry, and wherein the second substrate includes a recess region forming an integrated back cavity in the MEMS device. The MEMS device also includes an electrical connection electrically coupling the first substrate and the second substrate and configured to transmit an electrical signal indicative of the deflection of the diaphragm.

A further understanding of the nature and the advantages of particular embodiments disclosed herein can be realized by reference of the remaining portions of the specification and the attached drawings.

DETAILED DESCRIPTION

Figure 1:
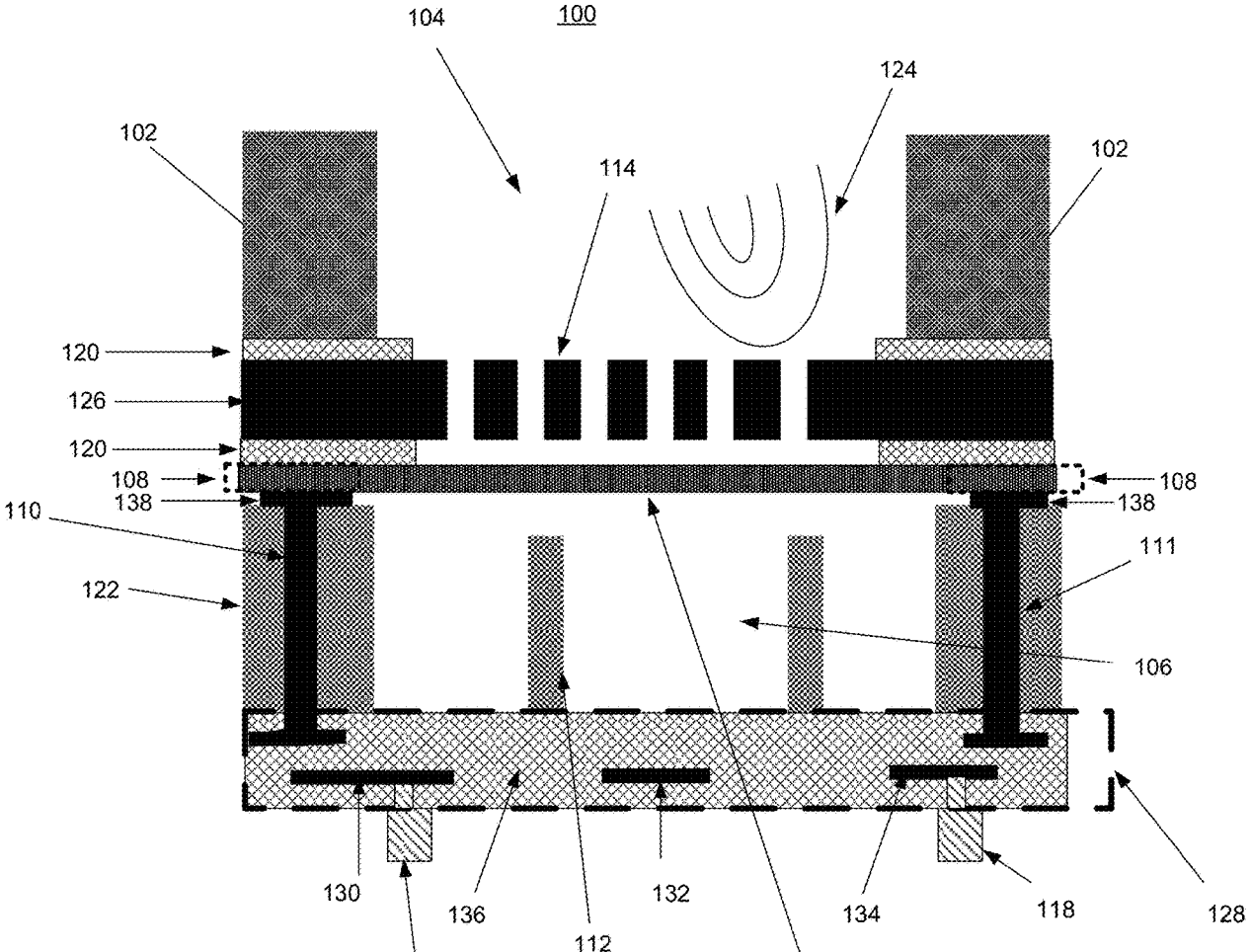
FIG. 1 illustrates an exemplary side view of a top port IBC MEMS device in accordance with one or more embodiments described herein.

A microphone is a device that converts sound pressure from acoustic waves received at a sensor to electrical signals. Microphones are used in numerous different applications including, but not limited to, hearing aids, voice recordation systems, speech recognition systems, audio recording and engineering, public and private amplification systems and the like.

MEMS microphones have numerous advantages including low power consumption and high performance. Additionally, MEMS microphones are available in small packages and facilitate use in a wide variety of applications that require a device with a small footprint. A MEMS microphone typically functions as a capacitive-sensing device, or acoustic sensor, that includes a pressure-sensitive diaphragm that vibrates in response to sound pressure resultant from an acoustic wave incident on the diaphragm. The acoustic sensors are often fabricated employing silicon wafers in highly-automated production processes that deposit layers of different materials on the silicon wafer and then employ etching processes to create the diaphragm and a plate. The air moves through the plate to the diaphragm, which deflects in response to the sound pressure associated with the air.

The sensed phenomenon is converted into an electrical signal. The electrical signal can be processed by an application specific integrated circuit (ASIC) for performing any number of functions of the MEMS microphone.

Embodiments described herein are MEMS microphones that have a top port and IBC. As used herein, the term "top port" means the port in the MEMS substrate is facing away from a PCB to which the top port IBC MEMS device is coupled. In some embodiments, the microphone is mounted on a PCB. It is desirable to have acoustic wave intended for the device travel into the device port and, from the port, travel into the diaphragm and cause electrical signals to be generated. However, for a bottom port design, the port in the microphone will face the PCB. A hole must then be provided through the PCB to allow the acoustic wave to travel to the MEMS microphone. Further, conventional bottom port microphones have an electrical connection through the laminate and there is a hole in the laminate. As such, the number of electrical solder bumps that can be provided on the surface of the top port IBC MEMS device is limited in bottom port microphones. Embodiments described herein can advantageously avoid the need for placement of a hole in the PCB.

Further, embodiments described herein also advantageously avoid the need to place holes in the CMOS die of the top port IBC MEMS device. The avoidance of holes allows for more electrical connection bonding as needed, and facilitates more complex functionality. For example, in these embodiments, since more electrical connection bonding can be provided, a codec can be integrated into the CMOS die. As another example, noise cancellation and/or song detection can also be employed in the embodiments described herein.

Finally, embodiments described herein employ an IBC, as opposed to an external back cavity design. An IBC design can advantageously result in cost reduction because there is wafer level bonding after fabrication and there is no need to perform a lamination step. As such, the cost of fabrication of the entire top port IBC MEMS device has no additional packaging cost. A large cost component for all microphones is the package. Typically, there would be a microphone and a laminated surface or a PCB with a hole would need to be placed and a lid would need to be placed on the entire arrangement. No packaging is needed in the embodiments described herein and the top port IBC MEMS device can be mounted directly to a PCB. In some embodiments, the IBC design can also result in a high signal-to-noise (SNR) ratio microphone.

Turning now to the drawings, FIG. 1 illustrates an exemplary side view of a top port IBC MEMS device in accordance with one or more embodiments described herein. In some embodiments, top port IBC MEMS device 100 can be or include a top port IBC MEMS microphone in some embodiments.

Top port IBC MEMS device 100 of FIG. 1 includes MEMS substrate 102 having top port 104, a CMOS substrate 122 with IBC 106 and one or more over travel stops 112 embedded in recess region 106 of CMOS substrate 122, electrical connection 108, solder bumps 118, 119, plate 114, diaphragm 116 and dielectric material 120.

Dielectric material 120 (e.g., silicon) can be provided between the CMOS substrate 122 and the MEMS substrate 102 in some embodiments. In various embodiments, one or more of MEMS substrate 102, CMOS substrate 122, and diaphragm 116 can be coupled to one another (e.g., electrically via electrical connection 108 or otherwise) to perform one or more functions of the top port IBC MEMS device 100. An electrical connection between the MEMS substrate 102 and the CMOS substrate 122 and a PCB (not shown) external to the top port IBC MEMS substrate 102 can be facilitated via solder bumps 118, 119.

The diaphragm 116 can be a pressure-sensitive membrane. The diaphragm 116 can be a micro-machined structure that deflects or otherwise locates to a new position in response to acoustic wave 124. As described, in some embodiments, an acoustic sensor can be formed as a capacitor composed of the diaphragm 116 and the plate 114. In some embodiments, an electrode 138 can be provided on the CMOS substrate 122 and/or can be provided at any location within top port IBC MEMS microphone that enables electrode 138 to measure the displacement of the diaphragm 116. Electrode 138 can be a component contacting MEMS and CMOS dies in some embodiments.

In some embodiments, the plate 114 and the sensor substrate 126 are part of the same layer. As shown, the plate 114 can include a perforated region and a solid, non-perforated region. Specifically, the substantially vertical lines in the plate 114 can represent perforations in the plate 114 that are provided to allow acoustic waves 124 to pass through the plate 114 to the diaphragm 116. In some embodiments, sensor substrate 126 and plate 114 are formed from a silicon on insulator (SOI) layer. In some embodiments, the perforated region of the plate 114 is at least partially aligned with the port of the MEMS substrate 102. In some embodiments, the diaphragm 116 is at least partially aligned with the perforated region of the plate 114.

As shown, the diaphragm 116 can be positioned substantially parallel to the plate 114 when the diaphragm 116 is at rest (e.g., not experiencing deflection). In some embodiments, at least a portion of the diaphragm 116 and the plate 114 are positioned substantially parallel to one another when the diaphragm 116 is at rest. In various embodiments, the diaphragm 116 can be composed of polysilicon or a combination of silicon nitride, polysilicon and/or metal (e.g., aluminum). The plate 114 can be composed of single crystal silicon, polycrystalline silicon, or a combination of silicon nitride, single crystal silicon, polycrystalline silicon, and/or metal (e.g., aluminum).

The diaphragm 116 and the plate 114 can form a capacitor having a capacitance that varies as the distance between the diaphragm 116 and the plate 114 varies. The acoustic wave 124 enters the top port IBC MEMS device 100 through the port 104 formed through the MEMS substrate 102. The port 104 can be any size suitable for receiving and/or detecting the acoustic waves 124 intended to enter the top port IBC MEMS device 100. Specifically, the port 104 can provide a recess/opening to an external environment outside of the MEMS device 100 such that sound generated external to the top port IBC MEMS device 100 is received by the port 104. Accordingly, the port 104 can be positioned at any number of different locations within MEMS substrate 102 in suitable proximity to the diaphragm 116 that allows the diaphragm 116 detect the acoustic waves generated external to the top port IBC MEMS device 100.

As described, acoustic waves 124 enter the MEMS device 100 via the port 104 provided through the MEMS substrate 102, pass through the perforated region of the plate 114 and are incident on the diaphragm 116. The diaphragm 116 deflects as a result of the sound pressure associated with the acoustic waves 124, and a capacitance results between the diaphragm 116 and the plate 114 based on the deflection. The CMOS substrate 122 measures the variation in voltage that results when the capacitance changes.

In some embodiments of top port IBC MEMS device 100, CMOS circuitry component 128 can be provided on or embedded within CMOS substrate 122 to facilitate electrical connection between top port IBC MEMS device 100 and a device external to top port IBC MEMS device 100. For example, the circuitry 130, 132, 134 can be provided on or embedded within layer 136. In some embodiments, one or more surfaces of the CMOS circuitry component 128 are facing away from the MEMS substrate 102. The circuit side of the CMOS substrate 122 can face away from the IBC 106 or be on a surface of the CMOS substrate 122 other than the surface within the IBC 106.

Figure 3:
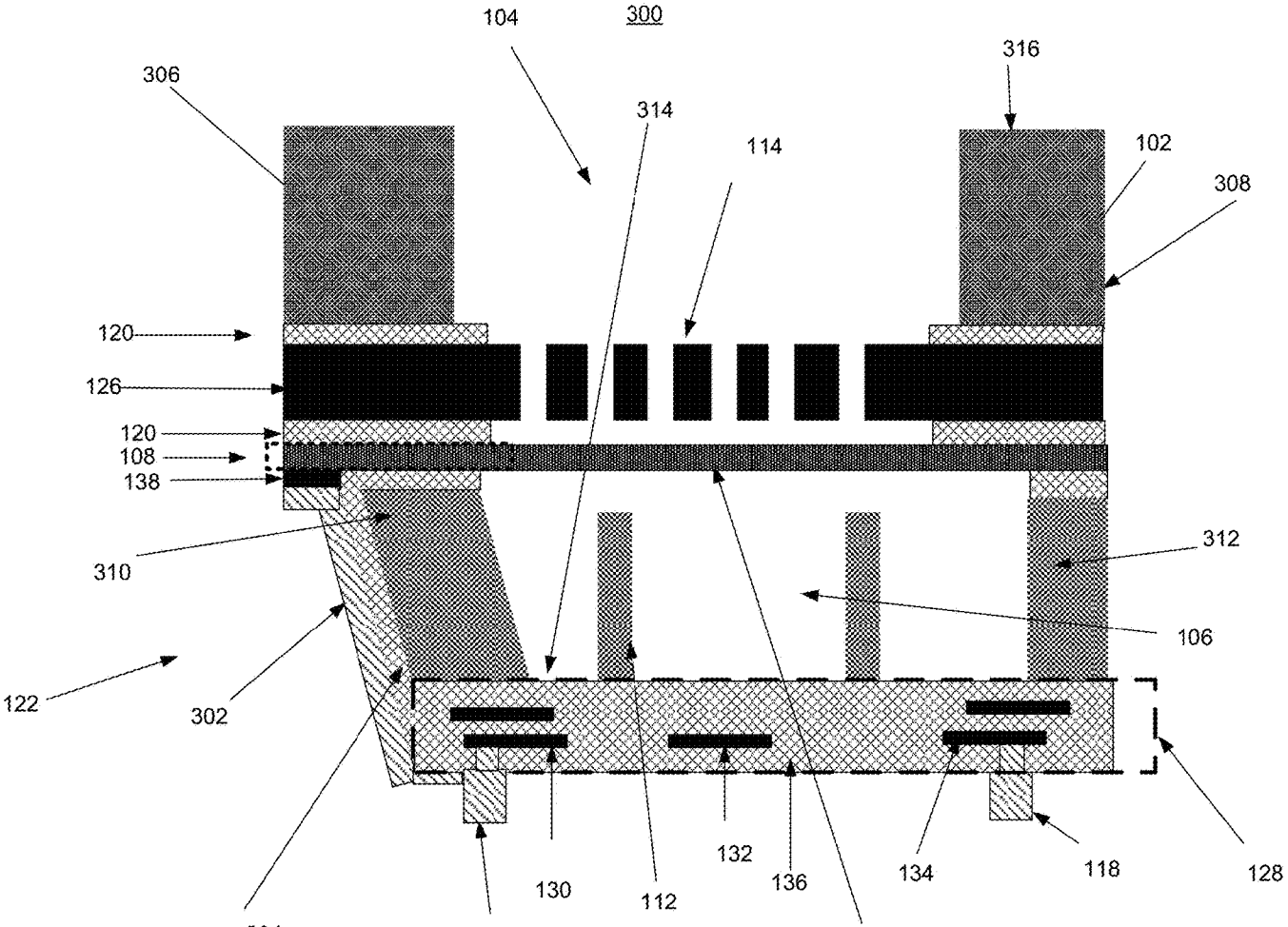
FIG. 3 illustrates an exemplary side view of another top port IBC MEMS device in accordance with one or more embodiments described herein.

As shown in FIG. 1, in some embodiments of top port IBC MEMS device 100, one or more through silicon vias (TSVs) 110, 111 can be provided to electrically connect the CMOS substrate 122 to the MEMS substrate 102 via the electrical connection 108. In other embodiments, TSVs 110, 111 need not be provided. For example, as shown in FIG. 3, a connector 302 can be provided. In some embodiments, the connector 302 can be provided in a sloped routing configuration along a sloped external wall 310 of the CMOS substrate 122.

Turning back to FIG. 1, the MEMS substrate 102 and the CMOS substrate 122 are two different wafers that are then bonded together with material of the TSV 110. In the embodiment shown, the MEMS substrate 102 is stacked on the CMOS substrate 122 with an IBC 106 inside of the stacked configuration. In various aspects of the embodiments described herein, the IBC 106 can provide an acoustic sealed volume for waves entering the top port IBC MEMS device 100. In some embodiments, the IBC 106 can be employed to form an acoustic system having an acoustic integrated cavity similar to embodiments employing an external back cavity design. In some embodiments, one or more over travel stops 112 can be embedded in the recess region 106 of CMOS substrate 122 formed as a result of the IBC 106.

The one or more over travel stops can be positioned and/or configured to reduce the deflection of the diaphragm 116. Two over travel stops are shown in FIG. 1. However, in other embodiments, any number of over travel stops can be provided in IBC 106. When the pressure is very high from the acoustic waves 124, the diaphragm 116 can deflect and push into the IBC 106. The one or more over travel stops 112 can reduce the likelihood of, or prevent, the diaphragm 116 from excessive deflection into the IBC 106, which could lead to failure of the diaphragm 116.

In some embodiments, the diaphragm 116, dielectric material 120 and plate 114 are fabricated on the MEMS substrate 102. The diaphragm 116, dielectric material 120 and plate 114 along with the MEMS substrate can be considered a MEMS die in some embodiments.

In some embodiments, the solder bumps 118, 119, CMOS circuitry 130, 132, 134 and TSV 110, 111 can be fabricated on the CMOS substrate 122. The solder bumps 118, 119, CMOS circuitry 130, 132, 134 and TSV 110, 111 along with the CMOS substrate 122 can be considered a CMOS die in some embodiments.

While the components are shown in the particular arrangement illustrated in FIG. 1, in other embodiments, any number of different arrangements of the components is possible and envisaged.

Figure 2:
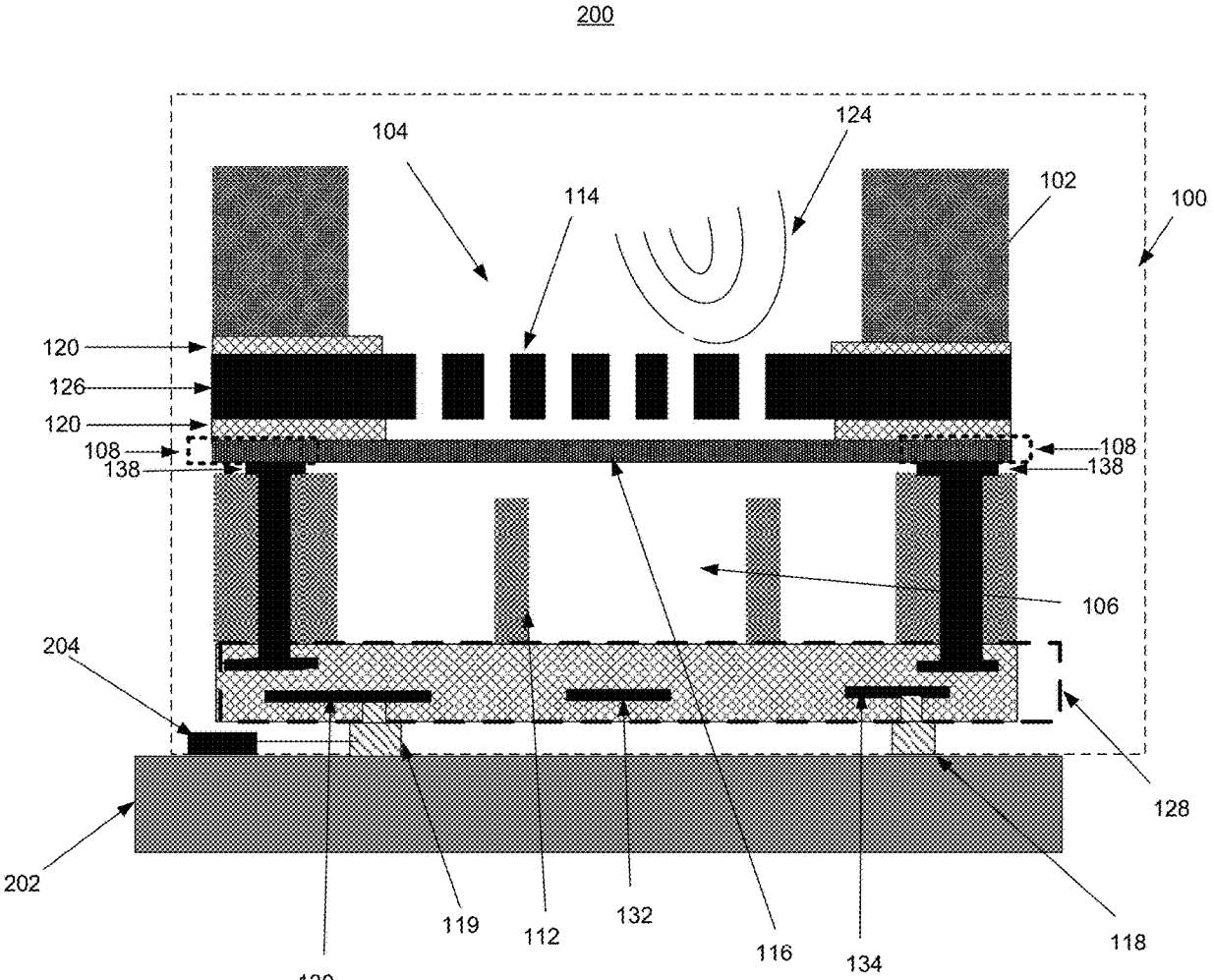
FIG. 2 illustrates the exemplary side view of a system including the top port IBC MEMS device of FIG. 1 on a printed circuit board (PCB) in accordance with one or more embodiments described herein.

FIG. 2 illustrates an exemplary side view of a system including the top port IBC MEMS device of FIG. 1 on a printed circuit board (PCB) in accordance with one or more embodiments described herein. Repetitive description of like elements employed in respective embodiments of systems and/or apparatus described herein are omitted for sake of brevity.

As shown, system 200 can include a top port IBC MEMS device 100 coupled to a PCB 202. The port 104 is the port opening in the MEMS substrate 102, and is facing away from the PCB 202. The electrical connection is provided through the solder bumps 118, 119 in the CMOS substrate 122. No port opening is required for the PCB 202.

Since the top port IBC MEMS device 100 is coupled to the PCB 202 at a circuit side that is opposite the port 104 in the MEMS substrate 102, no port need be provided through the PCB 202 to facilitate entry of acoustic waves to diaphragm 116. As such, greater surface area of the PCB 202 can be employed. Accordingly, with the significant surface area gained, noise cancellation circuitry, voice detection circuitry, song detection circuitry (e.g., device 204) and/or processors can be connected to top port IBC MEMS device 100 via one or more of solder bumps 118, 119 for use of the signals generated in response to the acoustic waves detected by the diaphragm. As such, in some embodiments, the system 200 can include a device 204 that receives information from top port IBC MEMS device 100 indicative of one or more acoustic waves (e.g., acoustic wave 124) indicative of speech representing a command (e.g., an audio command) received at the top port IBC MEMS device 100. The device 204 can also perform one or more functions based on the command. As such, the embodiments of the top port IBC MEMS device 100 described herein can be employed in any number of different systems including, but not limited to, mobile devices, smart watches, automobiles and/or wearable devices.

FIG. 3 illustrates another exemplary side view of a top port IBC MEMS device in accordance with one or more embodiments described herein. Repetitive description of like elements employed in respective embodiments of systems and/or apparatus described herein are omitted for sake of brevity. Shown is a side view of a sloped wall CMOS substrate 122 bonded to the MEMS substrate 102.

The top port IBC MEMS device 300 of FIG. 3 includes MEMS substrate 102 having port 104, a CMOS substrate 122 with IBC 106 and one or more over travel stops 112, solder bumps 118, 119, plate 114, diaphragm 116, dielectric material 120 and at least one MEMS contact pad (which is electrode 138 in some embodiments). In some embodiments, as shown later in FIG. 4, numerous MEMS contact pads/electrodes 138, 402, 404, 406 can be included in one or more different embodiments of top port IBC MEMS device 300. Dielectric material 120 can be provided between the CMOS substrate 122 and the MEMS substrate 102. In various embodiments, one or more of MEMS substrate 102, CMOS substrate 122 and diaphragm 116 can be coupled to one another (e.g., electrically via connector 302 or otherwise) to perform one or more functions of the top port IBC MEMS device 100. As such, the connector 302 can facilitate an electrical connection between the MEMS substrate 102, CMOS substrate 122, one or more of solder bumps 118, 119 and/or any circuitry or device (not shown) to which the one or more solder bumps 118, 119 may be connected.

In some embodiments of top port IBC MEMS device 100, CMOS circuitry component 128 can be provided on or embedded within CMOS substrate 122. For example, the circuitry 130, 132, 134 can be provided on or embedded in layer 136.

As shown in FIG. 3, in some embodiments of top port IBC MEMS device 100, CMOS substrate 122 can include at least one sloped wall 310 and a connector 302 can be provided along the sloped wall 310 of the CMOS substrate 122 in a sloped routing configuration. In some embodiments, the CMOS substrate 122 includes one sloped wall 310 and one non-sloped wall 312. In some embodiments, two or more walls of CMOS substrate 122 are sloped.

In some embodiments, the sloped wall 310 of the CMOS substrate 122 is sloped at an angle to facilitate the formation of the connector where the vertical sidewall coverage is challenging as in the case for physical vapor deposition of the connector like thin film sputtering and evaporation and for photosensitive material deployment used to pattern the connector. If the sidewalls 306, 308 are considered to be vertical at zero degrees, the sloped wall 310 can be at least fifteen degrees to facilitate the formation of the connector.

In some embodiments, one or more TSVs (not shown) can be provided to electrically connect the CMOS substrate 122 to the MEMS substrate 102 via the electrical connection 108 and TSVs 110, 111 of FIG. 1. In some embodiments, the sloped routing configuration of the connector 302 is provided on the surface 304 of the CMOS substrate 122.

Figure 4:
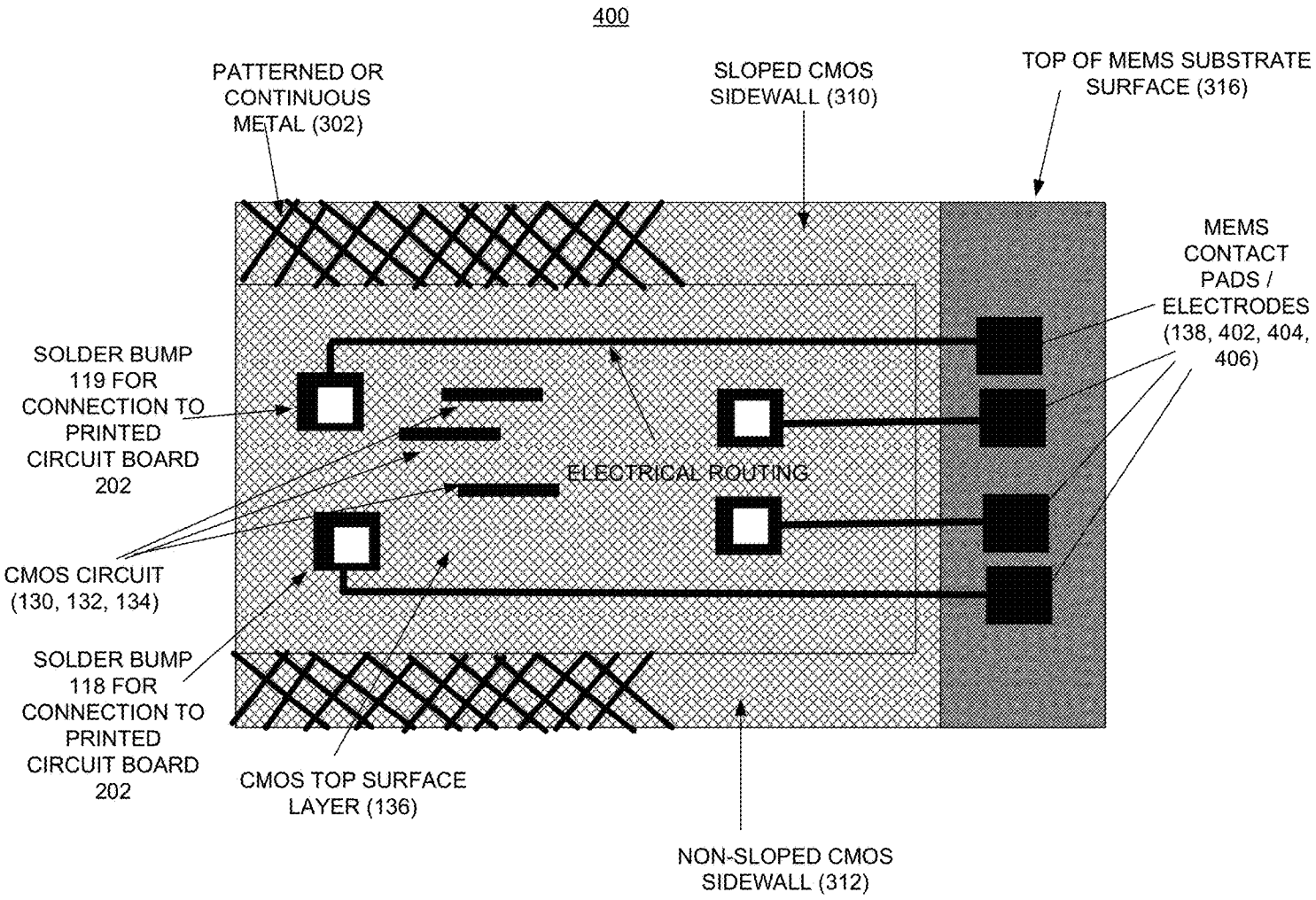
FIG. 4 illustrates an exemplary top view of the top port IBC MEMS device of FIG. 3 in accordance with one or more embodiments described herein.

In some embodiments, the connector 302 can be or be covered in metal to form a Faraday cage and/or to provide a radio frequency shield of the CMOS substrate 122 and/or the top port IBC MEMS device 102. The metal can be provided in any number of different patterns in various embodiments. FIG. 4 illustrates an exemplary top view of the top port IBC MEMS device of FIG. 3 in accordance with one or more embodiments described herein. Repetitive description of like elements employed in respective embodiments of systems and/or apparatus described herein are omitted for sake of brevity. As shown in FIG. 4, the metal can be provided in a patterned (e.g., crisscross) design. In some embodiments, the metal can be provided as a continuous material (as opposed to being provided in a pattern design). Numerous MEMS contact pads/electrodes 138, 402, 404, 406 can be provided and also shown are solder bumps 118, 119 for connection to a PCB (e.g., PCB 118, 119). The CMOS circuitry 130, 132, 134 are shown as well as the connector 302, which can be covered in continuous metal or a crisscross pattern of metal. In other embodiments, any number of other different types of patterns of metal can be provided on connector 302.

Figure 5:
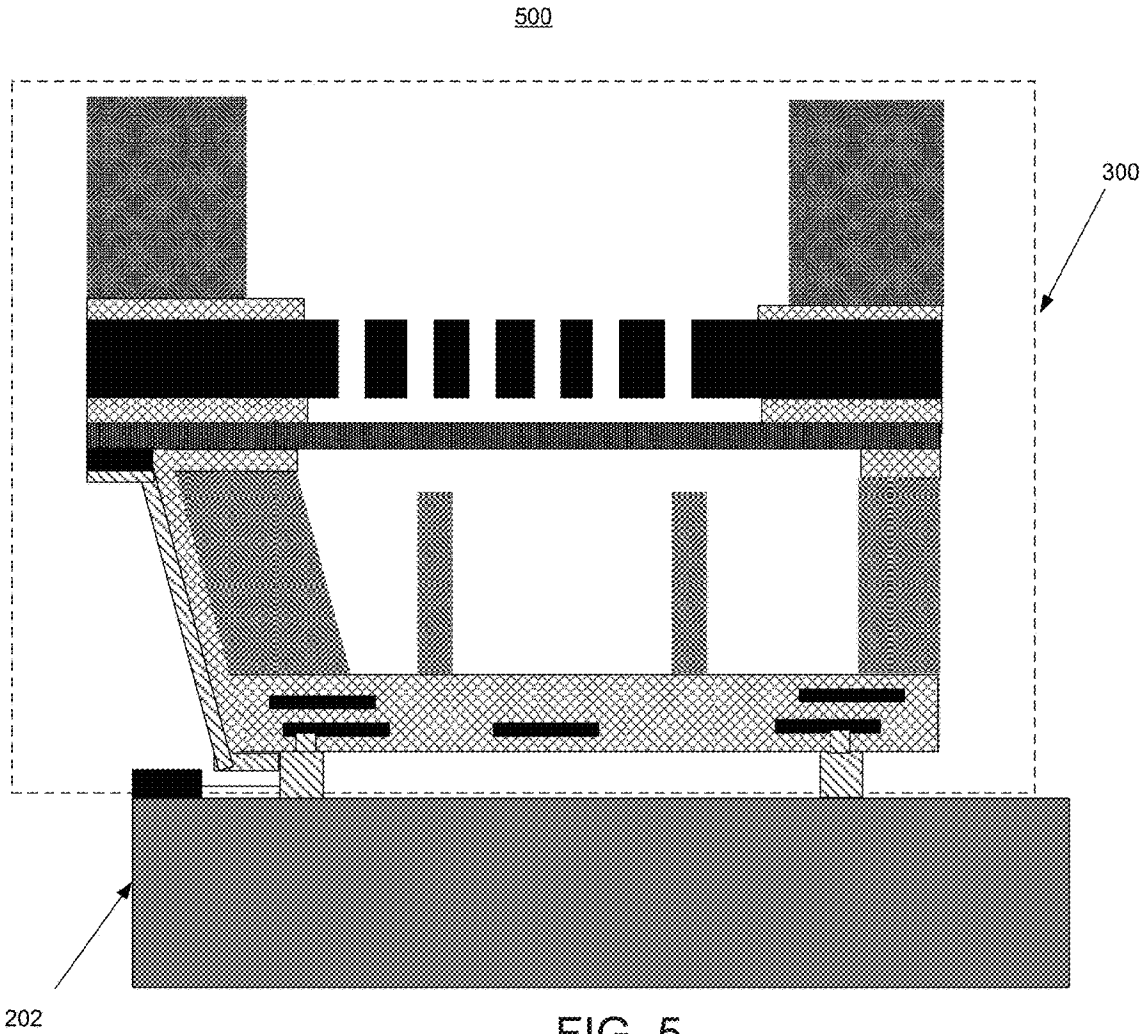
FIG. 5 illustrates the exemplary side view of a system including the top port IBC MEMS device of FIG. 3 on a PCB in accordance with one or more embodiments described herein.

FIG. 5 illustrates an exemplary side view of a system including the top port IBC MEMS device of FIG. 3 on a PCB in accordance with one or more embodiments described herein. Repetitive description of like elements employed in respective embodiments of systems and/or apparatus described herein are omitted for sake of brevity. As described, the top port IBC MEMS device 100 can be coupled to different systems and/or employed within any number of different types of systems that utilize microphone technology. As such, the embodiments of the MEMS device 100 described herein can be employed in different systems including, but not limited to, automobiles, mobile devices, smart watches and/or wearable devices. Although particular types of systems in which the top port IBC MEMS device 100 can be employed have been referenced, the description has provided only examples and thus the description is not limited to these particular embodiments. Other systems that employ the functionality that can be provided by the MEMS device 100 can also include the MEMS device 100 and are envisaged herein.

Figure 6:
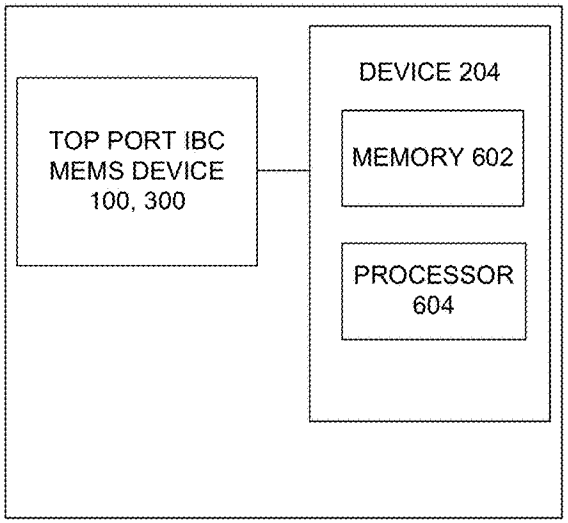
FIG. 6 illustrates an exemplary system employing a top port IBC MEMS device such as that described and/or illustrated with reference to FIGS. 1, 2, 3 and/or 5 in accordance with one or more embodiments described herein.

FIG. 6 illustrates an exemplary system employing a top port IBC MEMS device such as that described and/or illustrated with reference to FIGS. 1, 2, 3 and/or 5 in accordance with one or more embodiments described herein. Repetitive description of like elements employed in respective embodiments of systems and/or apparatus described herein are omitted for sake of brevity. The system 600 can include a device 204, MEMS device 100, 300, memory 602 and/or processor 604. In various embodiments, one or more of device 204, MEMS device 100, 300, memory 602 and/or processor 604 can be electrically and/or communicatively coupled to one another to perform one or more functions of system 600.

Memory 602 can store computer-executable instructions that can be executed by processor 604. For example, memory 602 can store instructions for performing any number of functions utilizing information generated by MEMS devices 100, 300 or the like. Processor 604 can process computer-readable storage medium computer-executable instructions to perform one or more of the functions described herein with reference to MEMS devices 100, 300, device 600, including, but not limited to, generating a signal indicative of detected acoustic waves, processing the generated signal to perform one or more functions of speech processing, functions of a wearable device or the like. In some embodiments, system 600 is or is included in an automobile, mobile device (e.g., mobile telephone, laptop, tablet, personal digital assistant), wearable article of clothing or the like.

Figure 7:
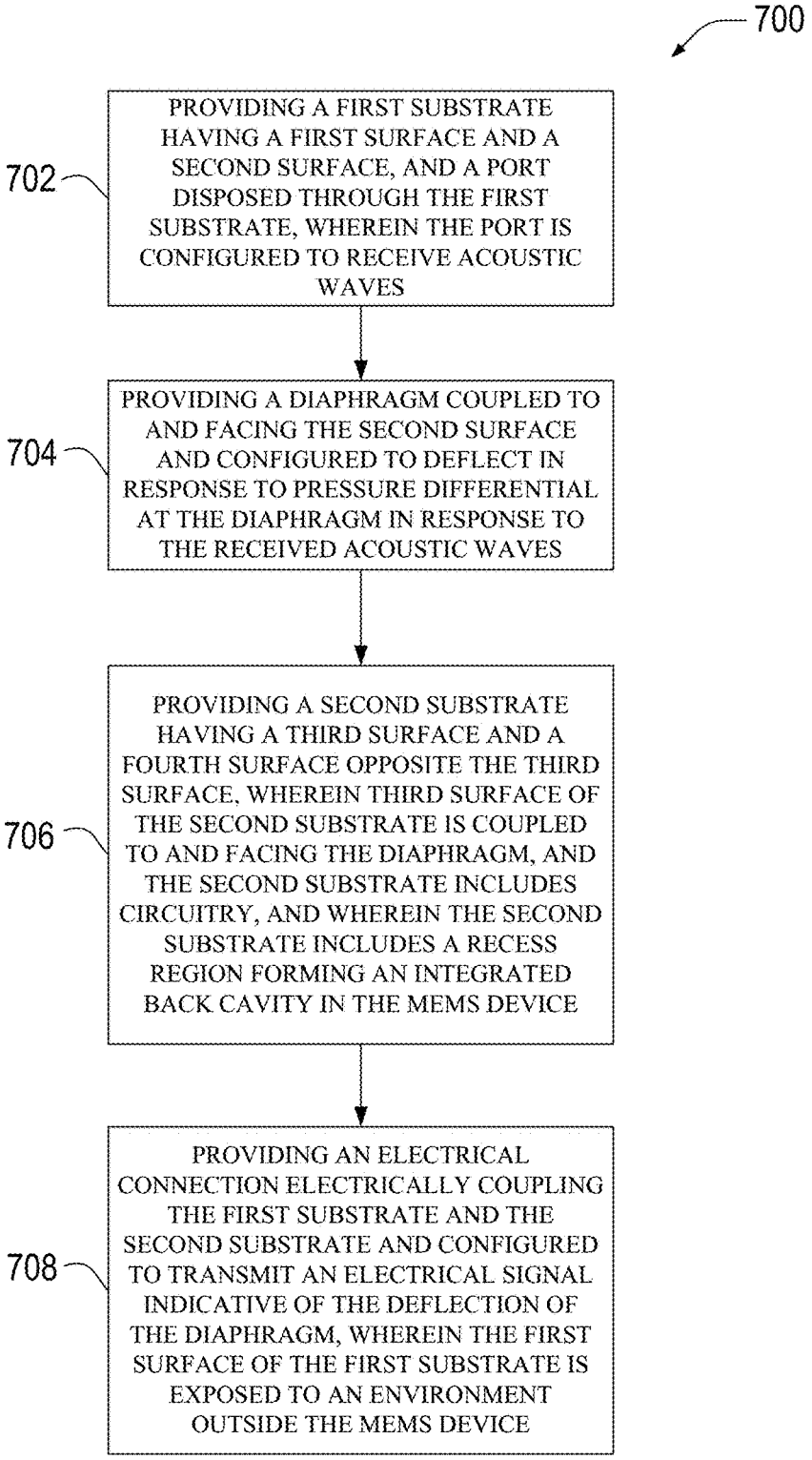
FIG. 7 illustrates an exemplary method of fabrication of the top port IBC MEMS device in accordance with one or more embodiments described herein with reference to FIGS. 1 and 2, respectively.

FIG. 7 illustrates an exemplary method of fabrication of the top port IBC MEMS device in accordance with one or more embodiments described herein with reference to FIGS. 1 and 2, respectively. Turning to FIG. 7, at 702, method 700 can include providing a first substrate having a first surface and a second surface, and a port disposed through the first substrate, wherein the port is configured to receive acoustic waves. The first substrate can be a MEMS substrate in some embodiments. The first surface of the first substrate is exposed to an environment outside the MEMS device.

At 704, method 700 can include providing a diaphragm coupled to and facing the second surface and configured to deflect in response to pressure differential at the diaphragm in response to the received acoustic waves. At 706, method 700 can include providing a second substrate having a third surface and a fourth surface opposite the third surface, wherein third surface of the second substrate is coupled to and facing the diaphragm and the second substrate includes circuitry, and wherein the second substrate includes a recess region forming an IBC in the MEMS device. In some embodiments, the second substrate is or includes a CMOS die having circuitry for coupling the CMOS die to a PCB or other circuitry or devices. In some embodiments, although not shown, method 700 can include providing one or more over travel stops embedded within the recess region of the second substrate. The one or more over travel stops can be positioned in the recess region of the CMOS to prevent the diaphragm from deflecting more than a defined amount thereby contributing to early fatigue of the diaphragm.

At 708, method 700 can include providing an electrical connection electrically coupling the first substrate and the second substrate and configured to transmit an electrical signal indicative of the deflection of the diaphragm. In various embodiments, the electrical connection includes a TSV electrical connection in the second substrate and/or a connector having a sloped routing configuration provided along at least a portion of an exterior boundary of the top port IBC MEMS device.

In some embodiments, although not shown, method 700 can also include providing a plate having a fifth surface and a sixth surface, wherein the fifth surface is coupled to and facing the second surface of the first substrate and has a perforated region configured to receive the acoustic waves that travel through the perforated region. The acoustic waves travel through the plate to the diaphragm in this embodiment.

In some embodiments, although not shown, method 700 can include providing an electrode on the second substrate and configured to measure displacement of the diaphragm. For example, the can detect the deflection of the diaphragm and measure an amount of deflection in some embodiments.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications can be made to adapt a particular situation or material to the essential scope and spirit.

What is claimed is:

1. A micro electro-mechanical system (MEMS) device, comprising:

a first substrate having a first surface and a second surface, and a port disposed through the first substrate, wherein the port is configured to receive acoustic waves and wherein the first surface is exposed to an environment outside the MEMS device;

a diaphragm coupled to and facing the second surface and configured to deflect in response to pressure differential at the diaphragm in response to the received acoustic waves;

a second substrate having a third surface and a fourth surface opposite the third surface, wherein third surface of the second substrate is coupled to and facing the diaphragm, and the second substrate includes circuitry, and wherein the second substrate includes a recess region forming an integrated back cavity in the MEMS device;

an electrode on the second substrate and configured to measure displacement of the diaphragm, wherein the electrode is in a back cavity of the MEMS device.

2. The MEMS device of claim 1, further comprising:

a plate having a fifth surface and a sixth surface, wherein the fifth surface is coupled to and facing the second surface of the first substrate and has a perforated region configured to receive the acoustic waves that travel through the perforated region.

3. The MEMS device of claim 1, wherein the MEMS device comprises a microphone.

4. The MEMS device of claim 1, wherein the first substrate comprises a MEMS substrate.

5. The MEMS device of claim 1, wherein the second substrate comprises a complementary metal oxide semiconductor (CMOS) substrate.

6. The MEMS device of claim 1, wherein the fourth surface is configured to be electrically coupleable to a printed circuit board.

7. The MEMS device of claim 1, further comprising one or more over travel stops embedded within the recess region of the second substrate.

8. The MEMS device of claim 1, wherein the electrical connection comprises a through silicon via electrical connection in the second substrate.

9. The MEMS device of claim 1, wherein the electrical connection comprises a sloped routing configuration provided along at least a portion of an exterior boundary of the MEMS device.

10. The MEMS device of claim 9, wherein the sloped routing configuration is provided on a sloped surface of the MEMS device, wherein the sloped surface is more than 10 degrees from a 0 degree defined vertical sidewall.

11. The MEMS device of claim 9, further comprising:

metal on the sloped routing configuration to form a Faraday cage.

12. The MEMS device of claim 11, wherein the metal is configured in at least one of a pattern configuration or solid configuration.

13. The MEMS device of claim 8, wherein the electrical connection is comprised of metal, and the electrical connection is configured to provide radio frequency noise shielding for the MEMS device.

14. The MEMS device of claim 1, further comprising:

one or more solder bumps coupled to the circuitry on the fourth surface of the second substrate and configured to electrically couple the second substrate to a printed circuit board.

15. The MEMS device of claim 2, wherein the perforated region is at least partially aligned with the port of the first substrate.

16. The MEMS device of claim 2, wherein the diaphragm is at least partially aligned with the perforated region of the plate.

17. A method, comprising:

providing a first substrate having a first surface and a second surface, and a port disposed through the first substrate, wherein the port is configured to receive acoustic waves;

providing a diaphragm coupled to and facing the second surface and configured to deflect in response to pressure differential at the diaphragm in response to the received acoustic waves;

providing a second substrate having a third surface and a fourth surface opposite the third surface, wherein third surface of the second substrate is coupled to and facing the diaphragm, and the second substrate includes circuitry, and wherein the second substrate includes a recess region forming an integrated back cavity in the MEMS device;

providing an electrical connection electrically coupling the first substrate and the second substrate and configured to transmit an electrical signal indicative of the deflection of the diaphragm, wherein the first surface of the first substrate is exposed to an environment outside the MEMS device; and providing an electrode on the second substrate and configured to measure displacement of the diaphragm, wherein the electrode is in a back cavity of the MEMS device.

18. The method of claim 17, further comprising:

providing a plate having a fifth surface and a sixth surface, wherein the fifth surface is coupled to and facing the second surface of the first substrate and has a perforated region configured to receive the acoustic waves that travel through the perforated region.

19. The method of claim 17, further comprising:

providing one or more over travel stops embedded within the recess region of the second substrate.

20. The method of claim 17, wherein the electrical connection comprises a through silicon via electrical connection in the second substrate.

21. The method of claim 17, wherein the electrical connection comprises a sloped routing configuration provided along at least a portion of an exterior boundary of the MEMS device.

22. A system, comprising:

a device comprising:

a memory to store computer-executable instructions; and a processor coupled to the memory, that facilitates execution of the executable instructions to perform operations comprising:

receipt, from a MEMS device, of information indicative of acoustic waves representative of speech including a command;

identification of the command; and performance of one or more functions based on the command; and a micro electro-mechanical system (MEMS) device operably coupled to the device and comprising:

a first substrate having a first surface and a second surface, and a port disposed through the first substrate, wherein the port is configured to receive the acoustic waves and wherein the first surface is exposed to an environment outside the MEMS device;

a diaphragm coupled to and facing the second surface and configured to deflect in response to pressure differential at the diaphragm in response to the received acoustic waves;

a second substrate having a third surface and a fourth surface opposite the third surface, wherein third surface of the second substrate is coupled to and facing the diaphragm, and the second substrate includes circuitry, and wherein the second substrate includes a recess region forming an integrated back cavity in the MEMS device;

an electrical connection electrically coupling the first substrate and the second substrate and configured to transmit an electrical signal indicative of the deflection of the diaphragm; and an electrode on the second substrate and configured to measure displacement of the diaphragm, wherein the electrode is in a back cavity region of the MEMS device.

23. The system of claim 22, wherein the system comprises a mobile device.

24. The system of claim 22, wherein the system comprises an automobile.

25. The system of claim 22, wherein the device comprises a wearable computing device.

* * * * *